US006299494B1

(12) United States Patent
Bowers et al.

(10) Patent No.: US 6,299,494 B1
(45) Date of Patent: Oct. 9, 2001

(54) ARTICULATING NOZZLE ASSEMBLY FOR WATER JET APPARATUS

(75) Inventors: William W. Bowers, Waukegan; James Mahnich, Lake Villa, both of IL (US)

(73) Assignee: Outboard Marine Corporation, Waukegan, IL (US)

( * ) Notice: Subject to any disclaimer, the term of this patent is extended or adjusted under 35 U.S.C. 154(b) by 35 days.

(21) Appl. No.: 09/591,305

(22) Filed: Jun. 9, 2000

(51) Int. Cl.[7] ..... B63H 11/113
(52) U.S. Cl. ..... 440/42
(58) Field of Search ..... 239/587.3; 440/38, 440/40, 42

(56) References Cited

U.S. PATENT DOCUMENTS

| | | | | |
|---|---|---|---|---|
| 777,053 | * | 12/1904 | Wilson | 239/587.3 |
| 1,044,164 | | 11/1912 | Goodrich . | |
| 1,196,176 | | 8/1916 | Tobin et al. . | |
| 2,111,553 | * | 3/1938 | Chew | 239/587.3 |
| 3,089,454 | | 5/1963 | Chronic | 115/12 |
| 3,094,966 | | 6/1963 | Meyer | 115/15 |
| 3,183,878 | | 5/1965 | Aschauer | 115/16 |
| 3,776,173 | | 12/1973 | Horwitz | 115/12 R |
| 3,788,265 | * | 1/1974 | Moore | 440/42 |
| 3,888,202 | | 6/1975 | Willyard | 115/16 |
| 3,946,556 | * | 3/1976 | Catterfeld | 60/221 |
| 4,605,376 | | 8/1986 | Aschauer | 440/38 |
| 4,964,821 | | 10/1990 | Tafoya | 440/38 |
| 5,049,096 | | 9/1991 | Henn | 440/41 |
| 5,222,863 | * | 6/1993 | Jones | 440/42 |

* cited by examiner

*Primary Examiner*—Ed Swinehart

(57) ABSTRACT

A water jet propulsion unit having an articulating exit nozzle assembly which serves as both a thrust nozzle and a steering nozzle. The assembly includes a flow-through inner housing or duct having a flanged portion with an inlet and a ball-shaped portion with an outlet, and a convergent nozzle having a spherical socket which fits around the ball-shaped portion of the inner duct. This ball and socket arrangement allows the nozzle to rotate relative to the ball-shaped portion of the inner duct. A limit pin on the duct projects into a slot formed in the nozzle wall to prevent rotation of the nozzle about a centerline of the duct. Abutment of the pin with the ends of the slot limit the trim angle of the nozzle to a predetermined range. A bracket is attached to the nozzle for controlling the angular position of the nozzle relative to the inner duct.

21 Claims, 5 Drawing Sheets

FIG.6
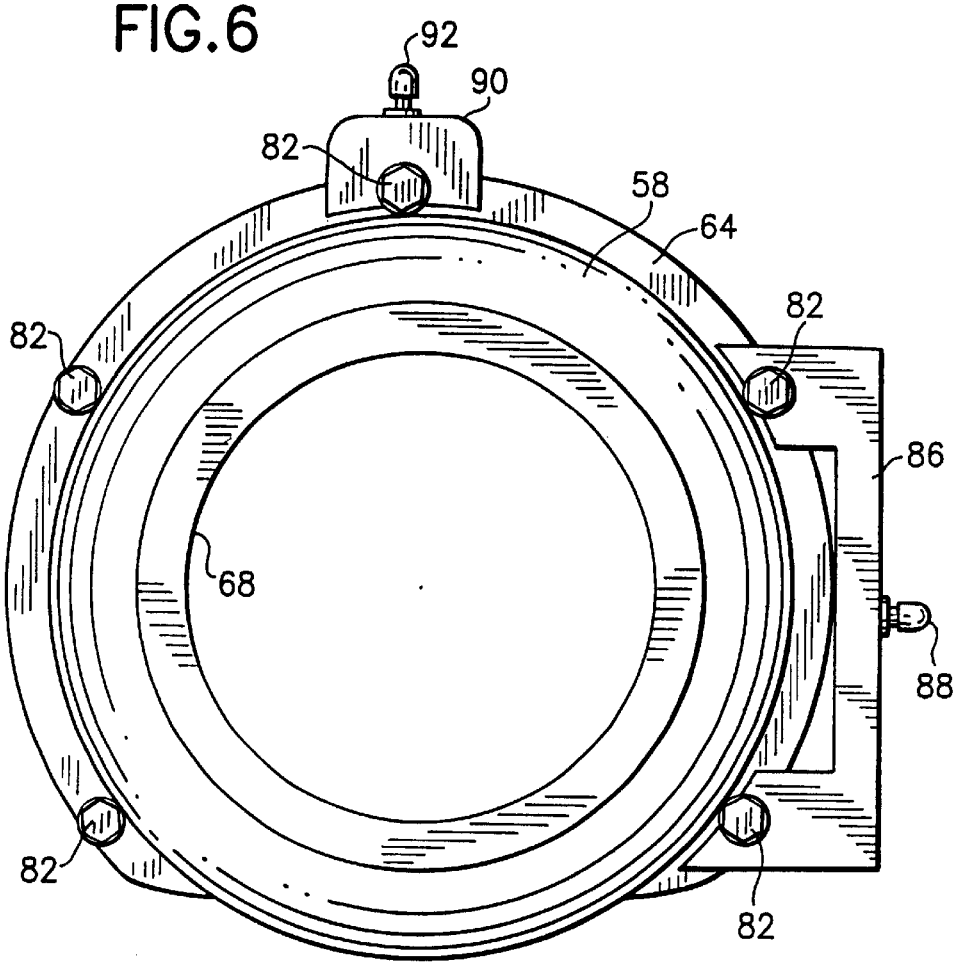
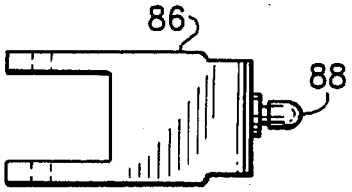
FIG.7
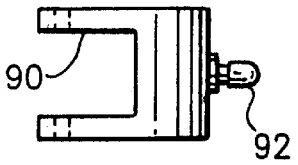
FIG.8

ARTICULATING NOZZLE ASSEMBLY FOR WATER JET APPARATUS

FIELD OF THE INVENTION

This invention generally relates to water jet apparatus for propelling boats and other watercraft. In particular, the invention relates to nozzles for a water jet propulsion unit.

BACKGROUND OF THE INVENTION

It is known to propel a boat or other watercraft using a water jet apparatus mounted to the hull, with the powerhead being placed inside (inboard) or outside (outboard) the hull. The drive shaft of the water jet apparatus is coupled to the output shaft of the motor. The impeller is mounted on the drive shaft and installed in a housing, the interior surface of which defines a water tunnel. The impeller is designed such that during motor operation, the rotating impeller impels water rearward through the water tunnel. The reaction force propels the boat forward.

The reaction force can be increased by increasing the speed at which the water jet exits the housing. One technique for accomplishing this is to form the exit portion of the housing in the shape of a nozzle having a convergent passageway which further accelerates the water flow therethrough. This type of nozzle is typically referred to as a thrust nozzle.

In order to provide horizontal directional control for the boat, the emerging water jet is diverted from its precisely rearward flow direction. This diversion is typically accomplished by means of a steering nozzle which is pivotably mounted to the housing in flow communication with the exit nozzle outlet. The pivot axis of the steering nozzle is preferably generally orthogonal to the centerline axis of the exit nozzle. The steering nozzle is typically steered remotely by the boat operator via control rods or cables which are coupled to the steering nozzle by control linkages. The steering nozzle may be pivoted horizontally in either direction to the desired extent to achieve the desired steering effect.

For example, U.S. Pat. No. 3,089,454 discloses a water jet propulsion system comprising a jet-producing nozzle which is surrounded by a housing consisting of two companion members, which are bolted together along adjacent flanges. The companion housing members form an open housing constituting a substantial portion of a hollow sphere. A jet-directing member for steering has an inner or forward portion which also forms part of a hollow sphere concentric with the housing and is rotatable within in the housing in the manner of a ball-and-socket arrangement. This inner or forward portion of the jet-directing member is pivotably mounted by means of a pair of diametrally opposite, radially extending pivot shafts rotatably mounted in the housing. The jet-directing member is pivotable to a limited extent on an axis perpendicular to the axis of the discharging end of the nozzle. A steering arm controls the positioning of the jet-directing member during steering.

In addition to steering, it is frequently desirable to control or change the boat's attitude. This can be accomplished, for example, by providing means for enabling the steering nozzle to pivot about a horizontal axis. This vertical pivoting action is similar to the horizontal pivoting action previously described, except that the range of vertical pivoting needed to provide the desired change in attitude (i.e., trim) angle is typically only about 20 degrees.

A water jet propulsion system having a jet nozzle with both horizontal and vertical pivoting action is disclosed in U.S. Pat. No. 3,776,173. In accordance with this system, the water flows through a housing which terminates in a substantially hemispherical flared portion. The spherical portion of the housing encloses a jet nozzle having a constricting passageway that accelerates the water flow. The nozzle comprises a substantially spherically configured bearing surface that is partially enclosed by and concentric with the flared hemispherical housing portion, the latter bearing against the nozzle bearing surface during rotation of the nozzle. The nozzle can rotate about mutually orthogonal pivot axes to achieve steering and attitude control respectively. During these rotations, the nozzle and flared housing portion behave in the manner of a ball and socket, except that the hemispherical flared housing portion only encloses part of and does not capture the nozzle.

There is a need for an articulated nozzle assembly having a convergent nozzle which can be rotated for both steering and attitude control, but which has a simple construction.

SUMMARY OF THE INVENTION

The present invention is directed to a water jet apparatus having an articulating nozzle assembly comprising a convergent nozzle which serves as both a thrust nozzle and a steering nozzle. The assembly comprises an inner housing or duct having a flanged portion with an inlet and a ball-shaped portion with an outlet, and a convergent nozzle having a socket portion which fits around the ball-shaped portion of the inner duct. This ball and socket arrangement allows the convergent nozzle to revolve about the ball-shaped portion of the inner duct.

In accordance with the preferred embodiment of the invention, rotation of the convergent nozzle about a centerline of the inner duct is prevented by an arrangement wherein a limit pin projecting outward from the duct is slidable in a slot formed in the nozzle wall. The slot has a width slightly greater than the outer diameter of the limit pin and a length greater than its width. Alternatively, the slot could be formed in the ball-shaped portion of the inner duct and the limit pin could extend inward from the nozzle. The slot is disposed to allow the convergent nozzle to tilt relative to the inner duct about a horizontal axis perpendicular to a centerline of the inner duct. Abutment of the limit pin with the ends of the slot limits the trim angle of the nozzle to a predetermined range. At any position of the limit pin along the slot, however, the convergent nozzle will be rotatable about the axis of the limit pin. Preferably a pair of brackets are attached to the nozzle for controlling the trim and steering angles of the convergent nozzle relative to the inner duct.

The preferred embodiment of the invention will be disclosed in the context of water jet propulsion system which is driven by an inboard motor. However, the person skilled in the art will readily appreciate that the articulating nozzle assembly disclosed herein has application beyond water jet propulsion systems driven by an inboard motor. For example, the articulating nozzle assembly disclosed herein has application in a water jet propulsion system driven by an outboard motor.

BRIEF DESCRIPTION OF THE DRAWINGS

FIGS. 5 and 6 are schematics showing side and end views respectively of the articulating nozzle assembly with angle control brackets attached in accordance with the preferred embodiment.

FIGS. 7 and 8 are schematics showing elevational views of the brackets used to control the angle of the convergent nozzle relative to the inner duct in accordance with the preferred embodiment of the invention.

DETAILED DESCRIPTION OF THE PREFERRED EMBODIMENTS

Figure 1:
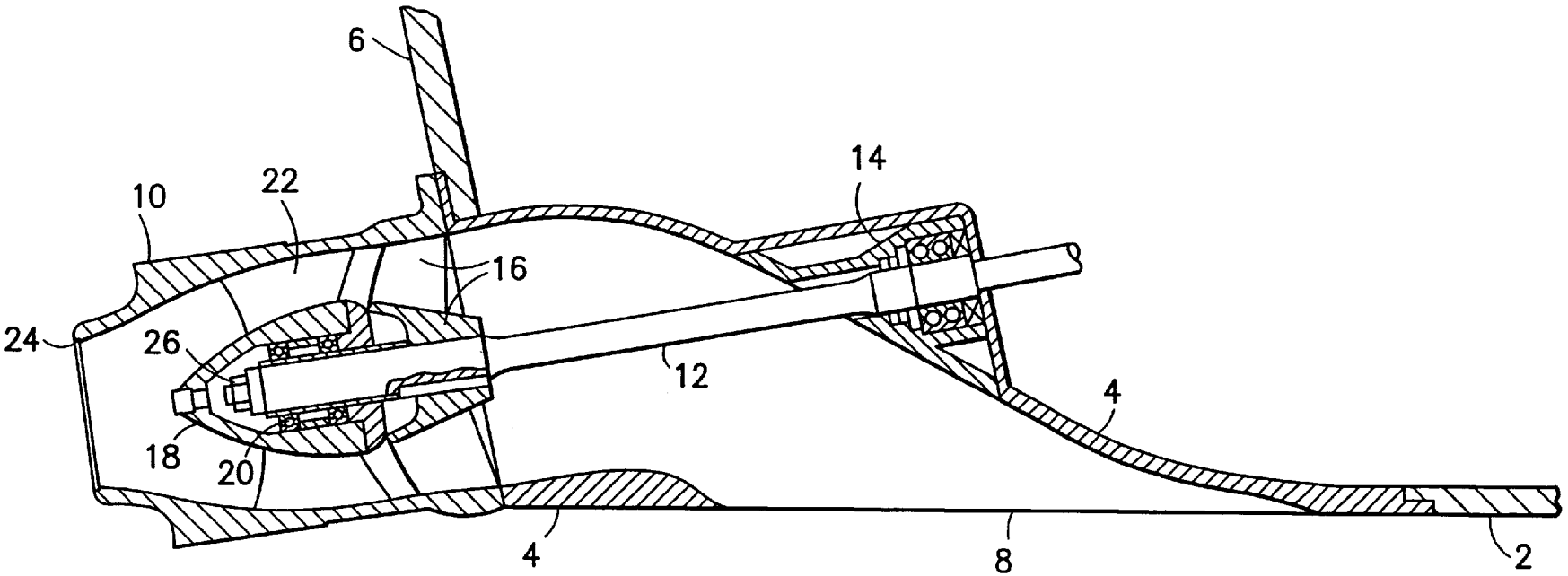
FIG. 1 PRIOR ART
FIG. 1 is a schematic showing an elevational sectional view of a conventional water jet propulsion system.

FIG. 1 depicts a conventional water jet apparatus mounted to a boat. The boat has a hull 2 with a water tunnel 4 installed in its stern. The water tunnel 4 has a height which gradually increases from its starting point to a maximum height located at the transom 6 of the hull. The water tunnel 4 is installed in an opening in the hull. The intake 8 of the water tunnel 4 lies generally in the plane of the bottom of hull 2 while the outlet of the water tunnel 4 lies generally in the plane of the transom 6.

In addition, the boat partially depicted in FIG. 1 comprises an outboard water jet propulsion unit having an inlet which is in flow communication with the outlet of the water tunnel 4. The water jet propulsion unit is powered by an inboard engine (not shown) by means of a drive shaft 12. The drive shaft 12 is rotatably mounted in a conventional fashion, e.g., by a first set of bearings installed in a bearing housing 14 mounted to the water tunnel and by a second set of bearings 20 installed in a stator hub 18 of the water jet propulsion unit.

An impeller 16 comprising a hub and a plurality of blades is mounted to the drive shaft 12. The hub and blades of impeller 16 are preferably integrally formed as one cast piece. As indicated by the cutaway portion of the drive shaft 12 seen in FIG. 1, the hub of impeller 16 and the drive shaft 12 are keyed so that the impeller will rotate in unison with the driveshaft. Alternatively, the impeller hub can be provided with a splined bore which meshes with splines formed on the external surface of the drive shaft. The impeller 16 is held securely on the drive shaft 12 by means of a lock nut 26 tightened onto a threaded end of the drive shaft 12. As seen in FIG. 1, the hub of the impeller 16 increases in radius in the aft direction, transitioning gradually from a generally conical outer surface at the leading edge of the impeller hub to a generally circular cylindrical outer surface at the trailing edge of the impeller hub. This outer surface of the impeller hub forms the radially inner boundary for guiding the flow of water impelled by the impeller.

The water jet propulsion unit shown in FIG. 1 also comprises a stator housing 10 which surrounds the impeller blades. The inner surface of the stator housing 10 forms the radially outer boundary for guiding the flow of water impelled by the impeller. The stator housing 10 has an inlet in flow communication with the outlet of the water tunnel 4. The stator housing 10 is connected to the stator hub 18 by a plurality of stator vanes 22. The stator hub 18 gradually decreases in radius in the aft direction to form a bullet-shaped tail cone, starting out at a radius slightly less than the radius at the trailing edge of the impeller hub. The tail cone may comprise a separate piece attached to the stator hub. The stator vanes 22 are designed to redirect the swirling flow out of the impeller 16 into non-swirling flow, i.e., the stator vanes are designed to remove the rotating component from the water as it leaves the impeller and cause the water to flow directly rearward. The stator housing 10 comprises an exit nozzle having an outlet 24.

Figure 2:
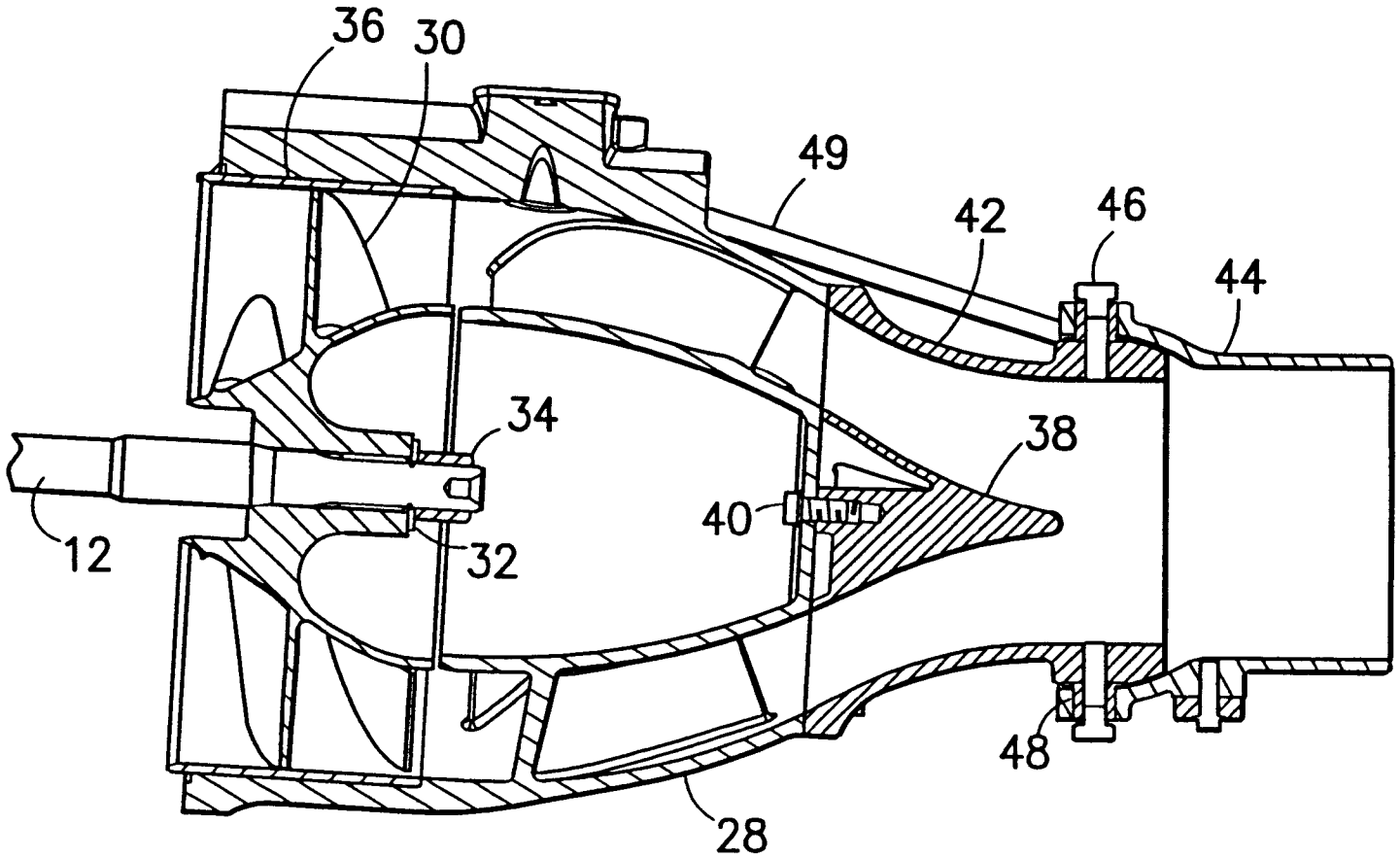
FIG.2 PRIOR ART
FIG. 2 is a schematic showing a partial elevational sectional view of another known water jet propulsion system.

An alternative known construction is shown in FIG. 2. This water jet propulsion unit comprises an impeller 30 mounted to a drive shaft 12. The hub of impeller 30 has a splined bore which meshes with splines formed on the external surface of the drive shaft 12, so that the impeller 30 will rotate in unison with the drive shaft. The impeller 30 is held securely on the drive shaft 12 by a nut washer 32, which in turn is held in place by a lock nut 34 tightened onto a threaded end of the drive shaft 12. A stator housing 28 comprises inner and outer shells connected by a plurality of stator vanes, all integrally formed as a single cast piece. The hub of the stator housing 28 gradually decreases in radius in the aft direction, starting out at a radius slightly less than the radius at the trailing edge of the impeller hub. The stator vanes are designed to redirect the swirling flow out of the impeller 30 into non-swirling flow. The stator housing hub has a radial end face with a central throughhole. Before the stator housing is installed, a tail cone cover 38 is attached to the radial end face of the stator housing hub by a screw 40. The front of the stator housing 28 is then attached to the rear of an inlet housing (not shown). A circumferential recess in the stator housing 28 at a position opposing the impeller blade tips has a circular cylindrical wear ring 36 seated therein. The front of a convergent exit (i.e., thrust) nozzle 42 is attached to the rear of the stator housing 28. The front faces of the tail cone cover 38 and the exit nozzle 42 are preferably coplanar. The water flowing out of the stator housing 28 will flow through the space between the tail cone cover 38 and the exit nozzle 42, and then will exit the exit nozzle 42 at its outlet.

The water jet apparatus shown in FIG. 2 is provided with a steering nozzle 44 which can change the direction of the water exiting the exit nozzle 42. The steering nozzle 44 is pivotably mounted to the exit nozzle 42 by a pair of pivot assemblies located at the top and bottom of the exit nozzle. Each pivot assembly comprises a screw 46, a sleeve (not visible in FIG. 1) and a bushing 48. The axes of the screws 46 are collinear and form a vertical pivot axis about which the steering nozzle 44 can rotate. The screws 46 are screwed into respective threaded holes in the exit nozzle 42. The steering nozzle 44 has an arm (not visible in FIG. 2) which is pivotably coupled to a flattened end of a steering rod 49. Displacement of the steering rod 49 in response to operation of a steering cable assembly (not shown) causes the steering nozzle to swing in a desired direction about its vertical pivot axis. In addition, a reverse gate can be pivotably mounted to the steering nozzle, stator housing, or exit nozzle for shifting the boat into reverse by reversing the flow exiting the steering nozzle 44. Structures for providing flow reversal are well known in the art.

The prior art water jet propulsion unit partly depicted in FIG. 2 has a non-convergent steering nozzle pivotably mounted to a convergent exit (i.e., thrust) nozzle. This arrangement does not provide means for tilting the steering or thrust nozzle in the elevational direction.

An articulating nozzle assembly for directing a water jet in accordance with a preferred embodiment will be disclosed with reference to FIGS. 3–6. It should be understood that this assembly can be mounted to a water jet propulsion unit comprising a duct-like housing with an inlet and outlet, an impeller rotatably mounted inside the housing, and a drive mechanism for causing the impeller to rotate and impel water toward the housing outlet. For example, the articulating nozzle assembly disclosed herein can installed in place of the exit nozzle and steering nozzle of the apparatus depicted in FIG. 2.

Figure 3:
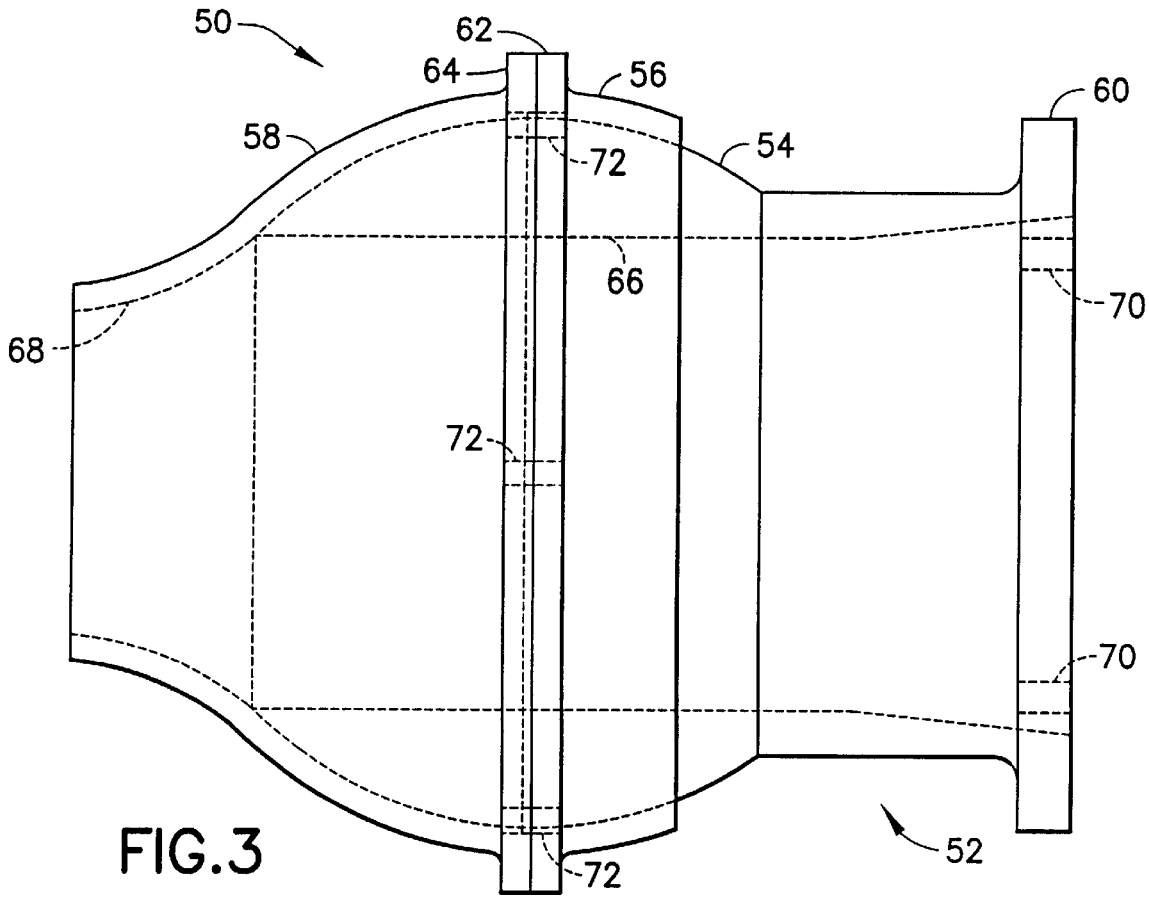
FIG. 3 is a schematic showing an articulating nozzle assembly in accordance with the preferred embodiment of the invention.

Referring to FIG. 3, the preferred embodiment of the invention is an articulating nozzle assembly comprising an inner duct 52 having a ball-shaped portion 54 and a nozzle 50 comprising parts 56 and 58 which form a socket rotatably mounted on the ball-shaped portion of the inner duct 52. The first nozzle part 56 has a flange 62 and the second nozzle part 58 has a flange 64, which flanges are fastened together by bolts 82 and nuts 84 (shown in FIGS. 5 and 6). The bolts are inserted in aligned holes 72 which are spaced along the flanges. Alternatively, the nozzle 50 could be formed as one piece, in which case flanges 62 and 64 in FIG. 3 would be omitted, and nozzle parts 56 and 58, shown in FIG. 3, would be integrally formed as a unitary ball-shaped socket.

Figure 4:
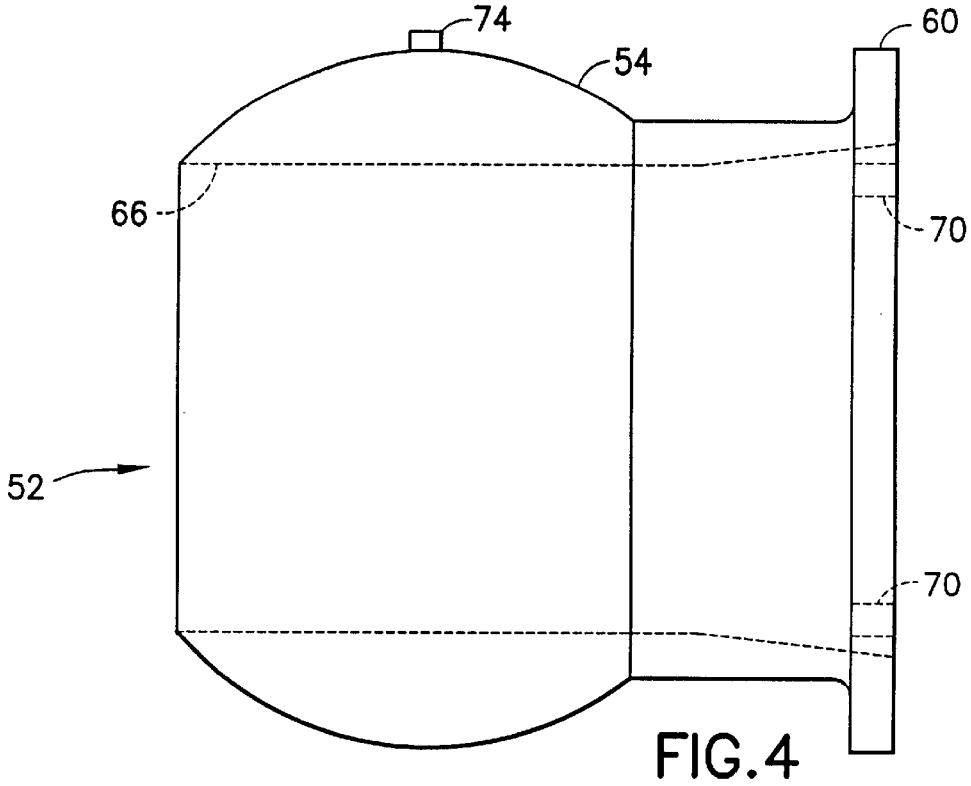
FIG. 4 is a schematic showing the inner duct incorporated in the preferred embodiment shown in FIG. 3.

The structure of the inner duct 52 is best seen in FIG. 4. The inner duct has a passage 66 (indicated by dashed lines) with an inlet and an outlet. A radial flange 60 is formed at the inlet end of the inner duct. The flange 60 has a plurality of holes 70 distributed circumferentially at equal angular intervals for receiving respective fasteners (not shown) for fastening the inner duct to a housing (e.g., a stator housing such as item 28 in FIG. 2) of a water jet apparatus. Preferably the passage 66 is formed in part by a circular cylindrical internal surface of the ball-shaped portion 54. The external surface of the ball-shaped portion 54 is preferably a section of a sphere. Similarly, the internal surface of nozzle part 56 (see FIG. 3) is preferably a section of a sphere having a radius slightly greater than that of the external surface of the ball-shaped portion 54, while a portion of the internal surface of nozzle part 58 is also preferably a section of a sphere having the same radius as the internal surface of nozzle part 56. The spherical internal surfaces of the nozzle 50 form a bearing surface or socket which revolves about the ball-shaped portion 54 of the inner duct 52. Persons skilled in the art will readily appreciate that this bearing surface need not be spherical, but rather may comprise other internal surfaces, e.g., a multiplicity of planar surfaces, designed to support the nozzle rotatably on the external surface of the ball-shaped portion 54.

The nozzle part 58 further comprises a non-spherical internal surface 68 which converges toward an outlet of the nozzle. The converging non-spherical internal surface 68 is a surface of revolution having a radius which decreases continuously from a maximum radius approximately equal to the radius of the outlet of passage 66 to a minimum radius at the nozzle outlet. This constriction of nozzle part 58 increases the velocity of the water flowing out of passage 66 of the inner duct 52, thereby increasing the thrust of the water jet apparatus.

Figure 5:
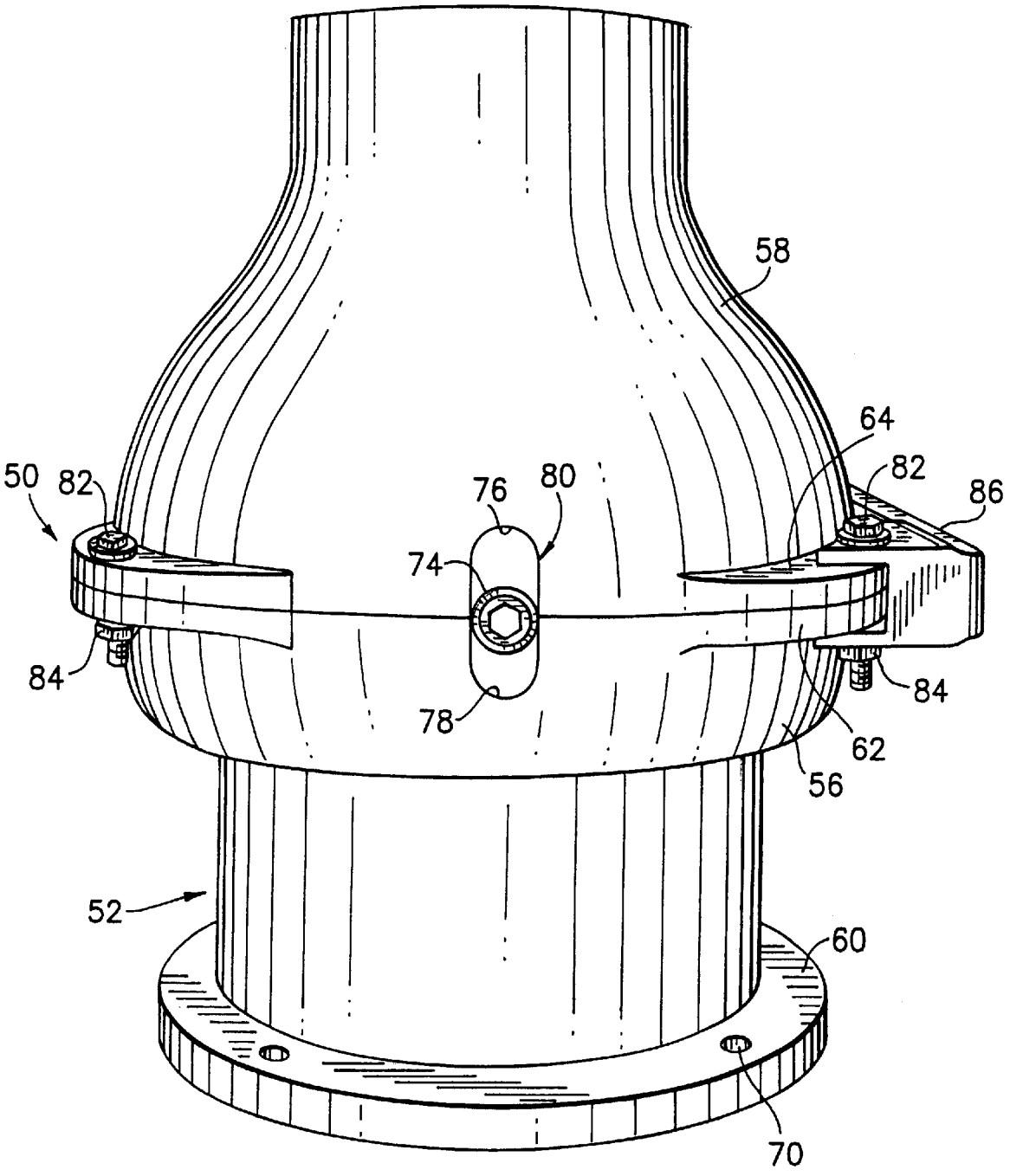

As best seen in FIG. 6, the flanges 62 and 64 preferably do not extend entirely around the circumference of the nozzle. In accordance with the preferred embodiment of the invention, one U-shaped recess 76 is formed in nozzle part 58 and another U-shaped recess 78 is formed in nozzle part 56, the U-shaped recesses 76 and 78 being in aligned opposition when the nozzle parts 56 and 58 are fastened together to form an oblong slot 80. In addition, a limit pin 74 is fixed to and projects radially outwardly from the ball-shaped portion 54 of the inner duct, as best seen in FIG. 4. As seen in FIG. 5, the limit pin 74 is circular and the slot 80 has parallel side edges separated by a width slightly greater than an outer diameter of the limit pin 74. The length of slot 80 is substantially greater than the outer diameter of limit pin 80, which allows the limit pin 80 to slide along the length of slot 80. The limit pin 74 and slot 80 cooperate to limit the relative motion of the inner duct 52 and the nozzle 50. The nozzle 50 is rotatable about a radial axis defined by the axis of limit pin 74. The nozzle is also tiltable about an axis which is substantially perpendicular to both the centerline of the inner duct and the axis of the limit pin. However, for a given radius of the ball-shaped portion 54 of the inner duct, the tilt angle range will be a function of the difference between the length of slot 80 and the outer diameter of pin 74. For a given limit pin diameter, the tilt angle range can be increased by increasing the slot length. Preferably the pin 74 and slot 80 are located on the respective spherical parts such that the nozzle 50 can be tilted relative to the inner duct centerline by positive and negative maximum tilt angles of equal magnitude, e.g., ±10 degrees.

In accordance with the preferred embodiment of the invention, means are provided for enabling a boat operator to control the tilt and steering angles of the convergent nozzle relative to the stationary inner housing or duct 54. Referring to FIG. 6, a tilt control coupling element 92 is attached to a tilt control bracket 90, the latter being in turn fastened to the abutting flanges 62 and 64 by a fastener. As seen in FIG. 8, the tilt control bracket 90 comprises a pair of parallel sides. The opposing sides are separated by a distance slightly greater than the combined thicknesses of the flanges 62 and 64 (see FIG. 5) so that the bracket 90 can sandwich the flanges and hold them together when a fastener is tightened. The fastener penetrates aligned holes in the bracket 86 and the flanges 62, 64, the fastener being located at position along the circumference of the nozzle which is generally opposite to the slot in the nozzle. The opposing sides of bracket 90 have aligned holes (indicated by dashed lines in FIG. 8) through which the fastener passes. Each fastener comprises a bolt 82 and a nut 84 of the type shown in FIG. 5. Thus, the bracket 90 clamps the sandwiched flanges together when sufficient tension is applied to the fastener. The tilt control coupling element 92 comprises a pin with a ball-shaped end for coupling in a conventional manner to a tilting lever, link or cable controlled by the boat operator. The tilt control coupling element 92 is preferably disposed generally diametrally opposite to the slot in the nozzle.

Similarly, a steering control coupling element 88 is attached to a steering control bracket 86, the latter being in turn fastened to the abutting flanges 62 and 64 by a pair of fasteners. As seen in FIG. 7, each end of the steering control bracket 86 comprises a pair of parallel sides. The opposing sides of each pair are separated by a distance slightly greater than the combined thicknesses of the flanges 62 and 64 (see FIG. 5) so that the bracket can sandwich the flanges and hold them together when respective fasteners are tightened. The fasteners penetrate respective aligned holes in the bracket 86 and the flanges 62, 64, the fasteners being located at respective positions along the circumference of the nozzle. The opposing sides at each end of bracket 86 have aligned holes (indicated by dashed lines in FIG. 7) through which the fastener passes. Each fastener comprises a bolt 82 and a nut 84 of the type shown in FIG. 5. Thus, bracket 86 also clamps the sandwiched flanges together when sufficient tension is applied to the fasteners. The steering control coupling element 88 comprises a pin with a ball-shaped end for coupling in a conventional manner to a steering lever, link or cable controlled by the boat operator. The steering control coupling element 88 is preferably positioned at a right angle relative to the diameter defined by the diametrally opposed slot (not visible in FIG. 6) and tilt control coupling element 92.

The nozzle 50 can be tilted and steered simultaneously or separately by operation of the mechanisms connected to pins 88 and 92, shown in FIG. 6. By tilting the nozzle 50 within the limits defined by the slot and the limit pin, the tilt angle of the water jet exiting the water jet apparatus can be altered to achieve a desired trim angle of the boat hull to which the water jet apparatus is mounted. At the same time or independently, the boat can be steered by rotating the nozzle about the axis of the limit pin.

The person skilled in the art will recognize that the articulating nozzle assembly shown in FIGS. 3–6 can be mounted to a housing and driven by an inboard motor via a drive shaft (in the manner depicted in FIGS. 1 and 2). In the alternative, an articulating nozzle assembly constructed in the manner shown in FIGS. 3–6 can be incorporated in a water jet propulsion unit mounted to and driven by an outboard motor.

Furthermore, in accordance with the preferred embodiments, the water jet apparatus comprises a housing or duct having a passage with an inlet and an outlet, and an impeller rotatably arranged for impelling water through the housing passage. The housing may be an integrally formed piece or an assembly of multiple components. For example, the housing may comprise a water tunnel or inlet housing, an impeller housing attached to the water tunnel or inlet housing, a stator housing attached to the impeller housing, and an inner housing or duct (of the articulating nozzle disclosed herein) attached to the stator housing. Alternatively, two or more of the foregoing components may be integrally formed as one piece. For example, the inner housing or duct disclosed herein may be integrally formed with a conventional stator housing.

Furthermore, although the convergent nozzle of the preferred embodiment comprises two flanged parts fastened together, the convergent nozzle may be integrally formed as one piece, e.g., by injection molding the nozzle in a trapped assembly.

While the invention has been described with reference to preferred embodiments, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

As used in the claims, the term "duct" encompasses any structure having a passageway with an inlet and an outlet, whether the duct is an integrally formed piece or an assembly of components, and regardless of whether the duct also serves as a housing for other components of a water jet apparatus, e.g., an impeller. In addition, as used in the claims, the term "connected" includes fastened, attached, joined, bonded, mounted or integrally formed and the term "spherical" means a portion of a sphere.

What is claimed is:

1. A water jet apparatus comprising:

a duct comprising an external surface having a shape of a portion of a first sphere, said external surface extending on both sides of a great circle of said first sphere, and an internal surface forming a passage with an inlet and an outlet;

an impeller rotatably arranged to impel water through said passage;

a nozzle pivotably mounted on said spherical portion of said external surface of said duct, said nozzle comprising a first portion having an internal surface which converges to an outlet in flow communication with said outlet of said duct, wherein said nozzle comprises first and second parts in abutment and securely coupled together, said nozzle being pivotable relative to said duct when said first and second parts are securely coupled.

2. The water jet apparatus as recited in claim 1, wherein said nozzle comprises a second portion having an internal surface having a shape of a portion of a second sphere, said internal surface extending on both sides of a great circle of said second sphere, said internal surface of said second portion having a radius slightly greater than a radius of said external surface of said duct.

3. The water jet apparatus as recited in claim 1, wherein said first part of said nozzle has a first flange and said second part of said nozzle has a second flange in contact with said first flange, further comprising fasteners for fastening.

4. The water jet apparatus as recited in claim 1, wherein said nozzle comprises a slot, further comprising a projection connected to said duct and extending radially outward into said slot.

5. The water jet apparatus as recited in claim 4, wherein said slot has parallel side edges separated by a width slightly greater than an outer diameter of said projection and a length greater than said width.

6. The water jet apparatus as recited in claim 4, wherein said slot is disposed to allow said nozzle to tilt about an axis perpendicular to a centerline of said duct.

7. The water jet apparatus as recited in claim 1, wherein said duct comprises a flange surrounding said inlet.

8. The water jet apparatus as recited in claim 1, further comprising means for preventing rotation of said nozzle about a centerline of said duct.

9. A water jet apparatus comprising:

a duct comprising an external surface having a spherical portion, and an internal surface forming a passage with an inlet and an outlet;

an impeller rotatably arranged to impel water through said passage; and a nozzle rotatably mounted on said spherical portion of said external surface of said duct, said nozzle comprising a first portion having an internal surface which converges to an outlet in flow communication with said outlet of said duct, wherein said nozzle comprises a first part having a first recess and a second part having a second recess, said first and second recesses forming a slot, further comprising a projection extending outward from said duct and into said slot.

10. A water jet apparatus comprising:

a duct comprising an external surface having a spherical portion, and an internal surface forming a passage with an inlet and an outlet;

an impeller rotatable arranged to impel water through said passage;

a nozzle rotatable mounted on said spherical portion of said external surface of said duct, said nozzle comprising a first portion having an internal surface which converges to an outlet in flow communication with said outlet of said duct, wherein said nozzle comprises a slot;

a projection extending outward from said duct and into said slot; and a tilt control coupling element connected external to said nozzle and positioned generally diametrally opposite to said slot.

11. The water jet apparatus as recited in claim 10, further comprising a steering control coupling element connected external to said nozzle and positioned at an angle between said slot and said tilt control coupling element.

12. A device for directing water flow, comprising:

a duct comprising an external surface having a shape of a portion of a first sphere, said external surface extending on both sides of a great circle of said first sphere, and an internal surface forming a passage with an inlet and an outlet; and a nozzle pivotably mounted on said spherical portion of said external surface of said duct, said nozzle comprising a first portion having an internal surface which converges to an outlet in flow communication with said outlet of said duct, wherein said nozzle comprises first and second parts in abutment and securely coupled together, said nozzle being pivotable relative to said duct when said first and second parts are securely coupled.

13. The device as recited in claim 12, wherein said nozzle comprises a second portion having an internal surface having a shape of a portion of a second sphere, said internal surface extending on both sides of a great circle of said second sphere, said internal surface of said second portion having a radius slightly greater than a radius of said external surface of said duct.

14. The device as recited in claim 12, wherein said nozzle comprises a slot, further comprising a projection connected to said duct and extending radially outward into said slot.

15. The device as recited in claim 14, wherein said slot is disposed to allow said nozzle to tilt about an axis perpendicular to a centerline of said duct.

16. The device as recited in claim 12, further comprising means for preventing rotation of said nozzle about a centerline of said duct.

17. A device for directing water flow, comprising:

a duct comprising a ball-shaped portion and a passage with an inlet and an outlet, said outlet being located in said ball-shaped portion; and a convergent nozzle comprising a socket portion which is pivotable relative to said ball-shaped portion of said duct in steering and trimming directions, said convergent nozzle having an outlet in flow communication with said outlet of said duct, wherein said socket portion comprises abutting and fastened first and second spherical sections which are pivotable relative to said ball-shaped portion of said duct.

18. The device as recited in claim 17, wherein said convergent nozzle comprises a slot, further comprising a projection connected to said duct and extending radially outward into said slot.

19. The device as recited in claim 18, wherein said slot is disposed to allow said convergent nozzle to tilt about an axis perpendicular to a centerline of said duct.

20. The device as recited in claim 17, further comprising means for preventing rotation of said convergent nozzle about a centerline of said duct.

21. A water jet apparatus comprising:

a duct comprising a ball-shaped portion and a passage with an inlet and an outlet, said outlet being located in said ball-shaped portion;

an impeller rotatably arranged in said passage to impel water toward said outlet of said duct; and a convergent nozzle comprising a socket portion which is pivotable relative to said ball-shaped portion of said duct in steering and trimming directions, said convergent nozzle having an outlet in flow communication with said outlet of said duct, wherein said socket portion comprises abutting and fastened first and second spherical sections which are pivotable relative to said ball-shaped portion of said duct.

* * * * *